US005352935A

United States Patent [19]

Yamamura et al.

[11] Patent Number: 5,352,935

[45] Date of Patent: Oct. 4, 1994

[54] SEMICONDUCTOR INTEGRATED CIRCUIT DEVICE WITH INTERNAL VOLTAGE CONTROLLING CIRCUIT

[75] Inventors: Ryuji Yamamura; Tadahiko Sugibayashi; Takahiro Hara, all of Tokyo, Japan

[73] Assignee: NEC Corporation, Japan

[21] Appl. No.: 955,287

[22] Filed: Oct. 1, 1992

[30] Foreign Application Priority Data

Oct. 18, 1991 [JP] Japan ..... 3-269823

[51] Int. Cl.[5] ..... G05F 1/56

[52] U.S. Cl. ..... 307/296.4; 307/272.3; 323/313

[58] Field of Search ..... 307/296.4, 296.5, 296.6, 307/296.8; 323/313, 314

[56] References Cited

U.S. PATENT DOCUMENTS 5,063,304 11/1991 Iyengar ..... 307/296.6

*Primary Examiner*—Timothy P. Callahan
*Assistant Examiner*—Shawn Riley
*Attorney, Agent, or Firm*—Laff, Whitesel, Conte & Saret

[57] ABSTRACT

A semiconductor integrated circuit device has a first internal voltage controlling circuit which lowers an external power source voltage and produces a predetermined internal power source voltage. The device further has a second internal voltage controlling circuit formed by an internal-voltage drop detection circuit for detecting the lowering of the internal power source voltage from a predetermined reference voltage and a switching circuit for causing the external power source voltage to be directly connected to an internal voltage output terminal based on an output from the internal-voltage drop detection circuit. The internal power source voltage is maintained close to the required value thereby preventing a deterioration of circuit performance even when the external power source voltage drops close to the internal power source voltage.

3 Claims, 3 Drawing Sheets

SEMICONDUCTOR INTEGRATED CIRCUIT DEVICE WITH INTERNAL VOLTAGE CONTROLLING CIRCUIT

BACKGROUND OF THE INVENTION

1. Field of the Invention

The present invention relates to a semiconductor integrated circuit device, and more particularly to a semiconductor integrated circuit device such as a large scale memory device which has an internal voltage controlling circuit for lowering an externally supplied voltage to produce an internal power source voltage.

2. Description of the Related Art

In recent years the degree of integration of semiconductor integrated circuit devices has advanced remarkably and, along with this, the transistor which is used as an active element therein has been dramatically miniaturized. The higher degree of integration of circuits is accompanied by problems such as the occurrence of hot carriers caused by an increase in internal electric fields and the decrease in the reliability of insulation oxide films and, in order to solve these problems, it is usual to lower the power source voltage. Since the externally supplied voltage is normally 5 V, a means employed for internally lowering the external power source voltage is to internally provide an internal voltage controlling circuit in a semiconductor integrated circuit device, whereby the required voltage, for example, 3 V is obtained.

A conventional semiconductor integrated circuit device of the kind explained above is equipped with an internal voltage controlling circuit 10 which includes, as shown in FIG. 1A, a differential circuit 2 constituted by a plurality of transistors T11–T14 for detecting the difference between a reference voltage $V_{REF}$ and an internal voltage $V_{INT}$, an output P-channel MOS transistor T1, and a transistor T2 as the current source for the differential circuit 2.

More specifically, the differential circuit 2 is a known circuit and includes the two N-channel MOS transistors T11 and T12 which are differentially connected and receive at their gates the internal voltage $V_{INT}$ and the reference voltage $V_{REF}$, respectively, and the two P-channel MOS transistors T13 and T14 which form a current-mirror circuit and function as load elements for the transistors T11 and T12, respectively.

Next, the operation of the conventional semiconductor integrated circuit device described above is explained.

In the internal voltage controlling circuit 10, when the internal power source voltage $V_{INT}$ applied to the gate of the transistor T11 becomes higher than the reference voltage $V_{REF}$ applied to the gate of the transistor T12 of the differential circuit 2, the drain current of the transistor T11 increases and the drain current of the transistor T12 decreases. On the other hand, since the transistors T13 and T14 functioning as the load elements for the transistors T11 and T12 constitute the current-mirror circuit, the transistor T14 operates so as to hold its drain current to the current value of the transistor T13 at the current input side and, as a result, the output voltage at the drain side of this transistor T14 rises. Accordingly, the gate potential of the output transistor T1 also rises, which means that, since the potential drops with respect to the source side of the transistor T1, the drain potential seen from the source side of the transistor T1 is caused to rise thereby lowering the output current. That is, the output voltage is lowered with reference to ground.

On the contrary, it can be readily understood that, when the internal power source voltage $V_{INT}$ becomes lower than the reference voltage $V_{REF}$, the output voltage rises due to the operation being the opposite of that explained above.

FIG. 1B shows a second example of the conventional semiconductor integrated circuit device having an internal voltage controlling circuit 20 in which, at the output side of the differential circuit 2, there is further provided a P-channel MOS transistor T3 connected to an external power source VC and in which the activating signal CA is applied to the gate of the transistor T3 and the gate of the transistor T2 which acts as the current source for the differential circuit 2.

In the internal voltage controlling circuit 20 of the second example of the conventional semiconductor integrated circuit device, only the transistor T3 is activated where the current supply capability may be small as in a stand-by state. The transistor T3 operates as a voltage drop circuit in which power consumption is small. Under normal operation, the overall circuit is activated by having the transistor T2 activated while the transistor T3 inactivated, so that a large current supply capability may be obtained.

FIG. 2 is a graph showing output voltage characteristics of the internal power source voltage $V_{INT}$ with regard to the external power source voltage VC in the conventional semiconductor integrated circuit device. As shown in the graph, when the external power source voltage VC becomes is high or higher than the reference voltage $V_{REF}$, the internal power source voltage $V_{INT}$ becomes a constant voltage equal to the reference voltage $V_{REF}$.

A problem in the conventional integrated circuit device explained above is that, when the external power source voltage drops to the neighborhood of the internal power source voltage, a voltage across the drain/source the output transistor of the internal voltage controlling circuit becomes small and, as a consequence, the current supply capability becomes poor resulting in a marked drop in the internal power source voltage and in deterioration of circuit performance. These are problems in the conventional semiconductor integrated circuit device, which are to be solved by the present invention.

SUMMARY OF THE INVENTION

It is, therefore, an object of the invention to overcome the problems in the conventional devices and to provide an improved semiconductor integrated circuit device having an internal voltage controlling circuit in which the internal power source voltage is prevented from being largely lowered even when the external power source voltage drops close to the internal power source voltage.

According to one aspect of the invention, there is provided a semiconductor integrated circuit device having a first internal voltage controlling circuit which lowers an external power source voltage supplied through an external voltage input terminal and produces at an internal voltage output terminal a predetermined internal power source voltage, the semiconductor integrated circuit device further having a second internal voltage controlling circuit comprising:

an internal-voltage drop detection circuit which detects when the internal power source voltage produced by the first internal voltage controlling circuit becomes lower than a predetermined reference voltage; and a switching circuit which is caused to be conductive by an output signal from the internal-voltage drop detection circuit so that the external power source voltage is directly supplied to the internal voltage output terminal.

BRIEF DESCRIPTION OF THE DRAWINGS

The above and other objects, features and advantages of the present invention will be apparent from the following description of a preferred embodiment of the invention explained with reference to the accompanying drawings, in which.

DESCRIPTION OF THE PREFERRED EMBODIMENT

Now, an embodiment of the invention is explained with reference to the accompanying drawings. It is to be noted that, throughout the following explanation, similar reference symbols or numerals refer to the same or similar elements in all the figures of the drawings.

Figure 3:
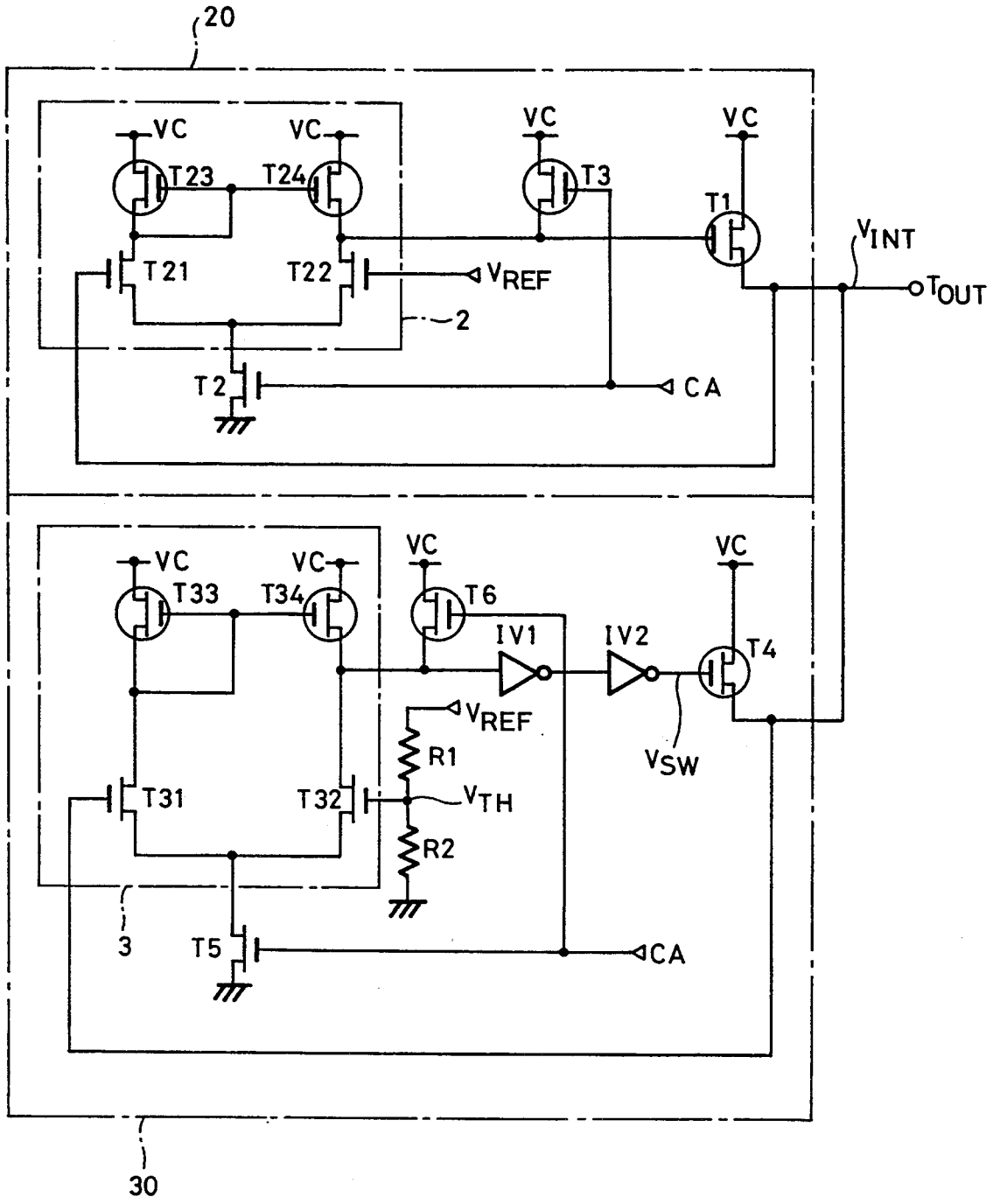
FIG. 3 is a circuit diagram showing a semiconductor integrated circuit device of an embodiment according to the present invention.

As shown in FIG. 3, the semiconductor integrated circuit device of the embodiment according to the invention has two large circuit blocks as an internal voltage controlling circuitry, namely, a first internal voltage controlling circuit 20 having a stand-by function with the same circuit configuration as that of the second example of the conventional circuit explained above, and a second internal voltage controlling circuit 30 which goes into operation when the external power source voltage drops.

More specifically, the second internal voltage controlling circuit 30 comprises resistors R1 and R2 connected in series for producing a threshold voltage $V_{TH}$ by dividing a reference voltage $V_{REF}$, a differential circuit 3 formed by a plurality of transistors T31–T34 for detecting the difference between the threshold voltage $V_{TH}$ and the internal voltage $V_{INT}$, two stage inverters IN1 and IN2 for amplifying the output voltage from the differential circuit 3, an output P-channel MOS transistor T4 as a switching circuit, and a transistor T5 as a current source for the differential circuit 3. If the stand-by function is required to this second internal voltage controlling circuit 30, a P-channel MOS transistor T6 may further be connected between the external voltage input terminal VC and the input node of the inverter IV1.

The differential circuit 3 is a known circuit in which the N-channel MOS transistors T31 and T32 receiving at their gates the internal voltage $V_{INT}$ and the threshold voltage $V_{TH}$, respectively, constitute a differentially operating circuit, and the P-channel MOS transistors T33 and T34 functioning as load elements for the transistors T31 and T32 constitute a current-mirror circuit.

Now, the operation of the circuit according to this embodiment is explained.

Figure 1A:
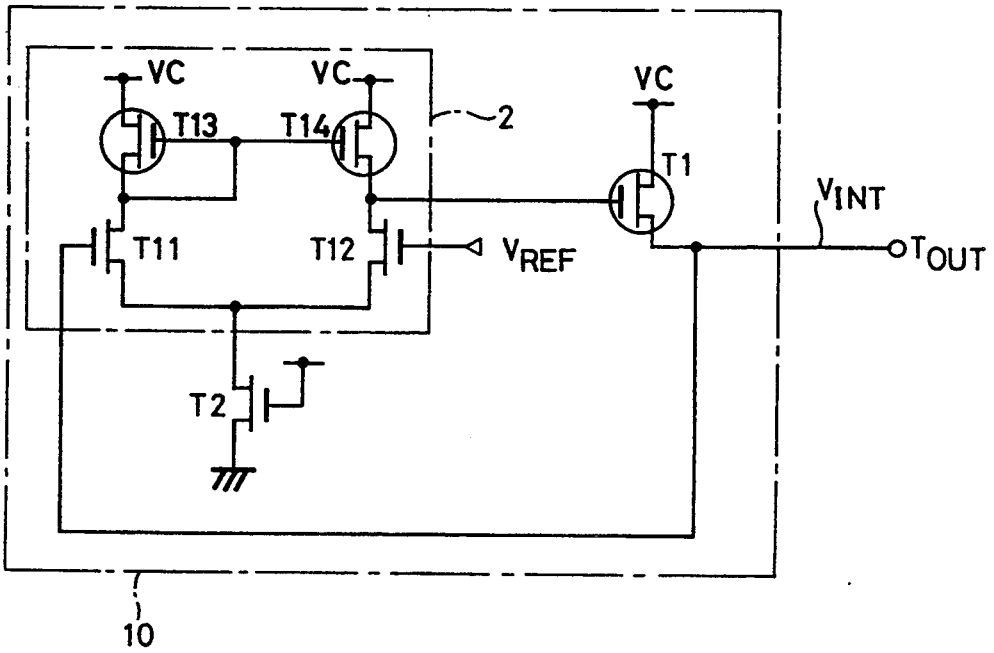
FIG. 1A PRIOR ART
FIG. 1A is a circuit diagram showing a first example of a conventional semiconductor integrated circuit device of the kind to which the present invention relates.
Figure 1B:
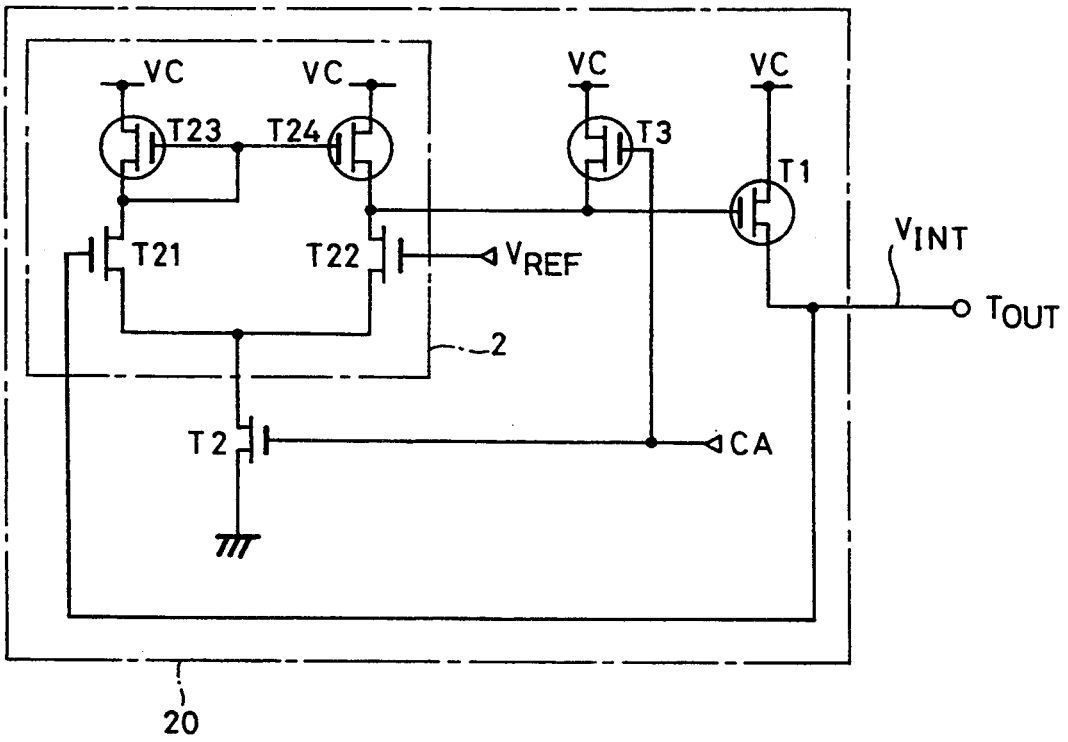
FIG. 1B PRIOR ART
FIG. 1B is a circuit diagram showing a second example of a conventional semiconductor integrated circuit device of the kind to which the present invention relates.
Figure 2:
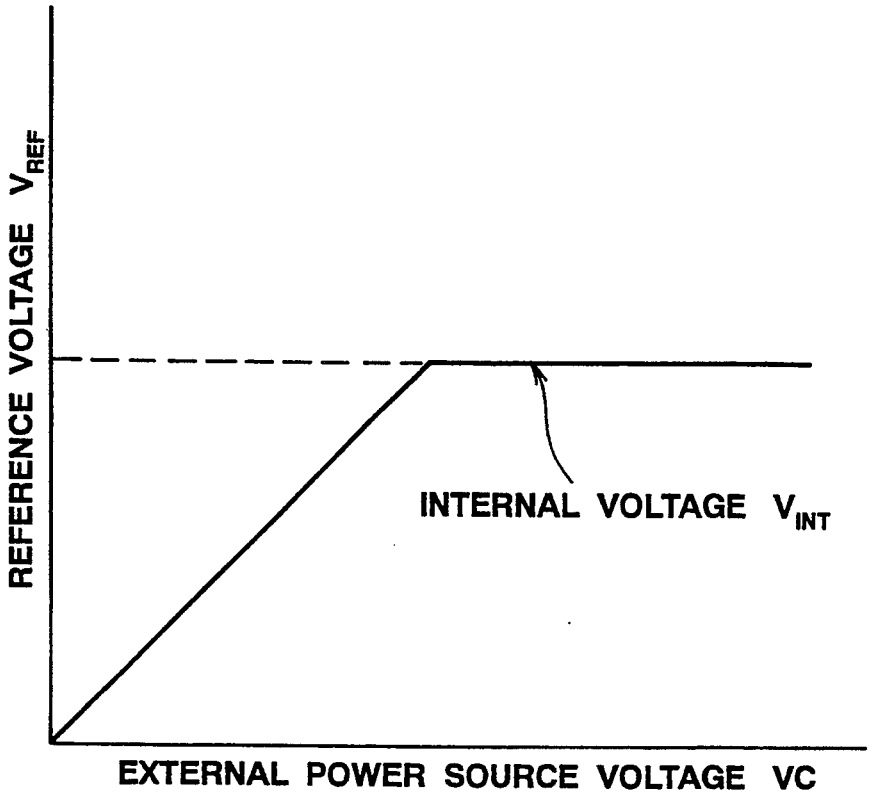
FIG. 2 PRIOR ART
FIG. 2 is a graph showing output characteristics representative of an example of the performance of the conventional semiconductor integrated circuit device.

Firstly, under normal operation, that is, when the external power source voltage VC is sufficiently higher than the internal power source voltage $V_{INT}$, the first internal voltage controlling circuit 20 operates as explained for the conventional circuit with reference to FIG. 1B and outputs to an internal voltage output terminal $T_{OUT}$ a predetermined internal power source voltage $V_{INT}$, for example, 3 V.

Next, when the external power source voltage VC drops resulting in the lowering of the internal power source voltage $V_{INT}$, in place of the first internal voltage controlling circuit 20, the second internal voltage controlling circuit 30 which goes into operation when the internal voltage $V_{INT}$ drops starts operating as explained hereinafter. That is, when the internal power source voltage $V_{INT}$ becomes the same or lower than the threshold voltage $V_{TH}$ resulting from the division of the reference voltage $V_{REF}$ by the series dividing resistors R1 and R2, the output voltage of the differential circuit 3 rises in the same way as the differential circuit 2 in the first internal voltage controlling circuit 20 operates. A change in the voltage corresponding to the rise in the differential circuit output voltage is amplified by the two-stage inverters IN1 and IN2 and the resulting voltage becomes a switching voltage $V_{SW}$ which has an amplitude approximately equaling to the external power source voltage VC. The switching voltage $V_{SW}$ causes the transistor T4 as the switching circuit to turn on so that the external power source voltage VC is directly outputted to the output terminal $T_{OUT}$ as the internal power source voltage $V_{INT}$.

The threshold voltage VTH is set to a level at which, when the external power source voltage VC is normal, the threshold voltage $V_{TH}$ does not produce the switching voltage $V_{SW}$ so that the transistor T4 is kept in its OFF-state whereas, when the external power source voltage VC drops and the internal power source voltage $V_{INT}$ is significantly lowered, the threshold voltage $V_{TH}$ does produce the switching voltage $V_{SW}$ so that the transistor T4 is caused to turn ON. The threshold voltage $V_{TH}$ thus set is, for example, 0.25 V.

As explained above, the semiconductor integrated circuit device according to the invention is provided with the internal-voltage drop detection circuit for detecting the lowering of the internal power source voltage from a predetermined threshold value and with the switching circuit for directly supplying the external power source voltage to the internal voltage output terminal based on the output of the internal-voltage drop detection circuit. Thus, the advantage achieved is that, since the lowering of the internal power source voltage is made small even when the external power source voltage drops close to the internal power source voltage, it is possible to prevent malfunctioning of the circuit.

While the invention has been described in its preferred embodiment, it is to be understood that the words which have been used are words of description rather than limitation and that changes within the purview of the appended claims may be made without departing from the true scope and spirit of the invention in its broader aspects.

What is claimed is:

1. A semiconductor integrated circuit device having a first internal voltage controlling circuit which lowers an external power source voltage supplied through an external voltage input terminal and produces at an internal voltage output terminal a predetermined internal power source voltage said semiconductor integrated circuit device further having a second internal voltage controlling circuit comprising:

an internal-voltage drop detection circuit which detects when said internal power source voltage produced by said first internal voltage controlling circuit becomes lower than a predetermined reference voltage, said internal-voltage drop detection circuit including a differential circuit whose output voltage changes when said internal power source voltage becomes lower than a predetermined threshold voltage, an inverter circuit which amplifies changes in the output voltage from said differential circuit to produce a switching output, and a threshold voltage setter for establishing said predetermined threshold voltage from said predetermined reference voltage; and a switching circuit which is caused to be conductive by said switching output from said inverter circuit so that said external power source voltage is directly supplied to said internal voltage output terminal.

2. A semiconductor integrated circuit device according to claim 1, in which said switching circuit comprises a transistor which is between said external voltage input terminal and said internal voltage output terminal and which is controlled to be conductive or nonconductive according to said switching output from said inverter circuit applied to a gate of said transistor.

3. A semiconductor integrated circuit device according to claim 1, in which said threshold voltage setter comprises a voltage dividing network formed by two resistors connected in series between said predetermined reference voltage and a ground, said threshold voltage being derived from a junction node between said two resistors.

* * * * *